US005119970A

United States Patent [19]

Arieh et al.

[11] Patent Number: 5,119,970

[45] Date of Patent: Jun. 9, 1992

[54] VALVE FOR AEROSOL CONTAINER

[75] Inventors: Simon Arieh, Geneva; Guy Courvoisier, Celigny, both of Switzerland; Pierre Soulière, Sergy, France

[73] Assignee: Givaudan Corporation, Clifton, N.J.

[21] Appl. No.: 598,598

[22] PCT Filed: Feb. 17, 1990

[86] PCT No.: PCT/EP90/00264

§ 371 Date: Oct. 16, 1990

§ 102(e) Date: Oct. 16, 1990

[87] PCT Pub. No.: WO90/09936

PCT Pub. Date: Sep. 7, 1990

[30] Foreign Application Priority Data

Feb. 27, 1989 [CH] Switzerland ..... 716/89

[51] Int. Cl.[5] ..... B65D 83/44

[52] U.S. Cl. ..... 222/1; 222/402.14; 222/402.16; 141/20

[58] Field of Search ..... 222/41, 402.1, 402.13, 222/402.14, 402.16, 505, 509, 564; 141/3, 20

[56] References Cited

U.S. PATENT DOCUMENTS

| | | | |
|---|---|---|---|
| 2,598,308 | 5/1952 | Samuels et al. | 299/150 |
| 2,858,053 | 10/1958 | Waldherr . | |
| 3,096,003 | 7/1963 | Nesin | 222/402.16 |
| 3,260,418 | 7/1966 | Clouzeau et al. | 222/41 |
| 3,330,481 | 7/1967 | Dearling | 222/402.13 |
| 3,527,388 | 9/1970 | Cooprider | 222/402.16 |
| 3,674,185 | 7/1972 | Evesque | 222/402.16 |
| 4,381,065 | 4/1983 | Hayes | 222/402.14 |
| 4,440,325 | 4/1984 | Treuhaft et al. | 222/402.14 |
| 4,441,634 | 4/1984 | Meshberg | 222/402.16 |
| 4,542,837 | 9/1985 | Rayner | 222/402.13 |

FOREIGN PATENT DOCUMENTS

| | | |
|---|---|---|
| 977312 | 11/1975 | Canada . |
| 1642020 | 3/1972 | Fed. Rep. of Germany . |
| 2083835 | 12/1971 | France . |
| 2090556 | 1/1972 | France . |
| 2104537 | 4/1972 | France . |
| 1605269 | 1/1974 | France . |
| 2352999 | 12/1977 | France . |
| 550708 | 6/1974 | Switzerland . |

*Primary Examiner*—Michael S. Huppert
*Assistant Examiner*—Gregory L. Huson

[57] ABSTRACT

A valve device useful for obtaining a predetermined and immediate appreciable initial rate of flow of aerosol from an aerosol container and a subsequent predetermined and small continuous rate of flow. The valve device contains a standard valve, which is crimped on the aerosol container, and a unidirectional valve, located within the aerosol container and connected on one side to the standard valve, the connecting element providing a passage from the unidirectional valve to the standard valve, and on the other side to a conduit connected to a plunger tube for access to the contents of the container. Within the body of the standard valve is a movable closure element having a spring which holds the valve closed. The valve may be opened by depressing the spring with an actuator located outside the container. A closure member is provided for acting on the actuator. The closure element of the unidirectional valve is a movable diaphragm which is held closed by a second spring. During the filling of the container, the unidirectional valve is held open by the pressure applied by fluid flowing through the opened standard valve, the passage, the unidirectional valve, the conduit, the plunger tube and into the container. After the container is filled, the unidirectional valve is held closed by both the second spring and the fluid under pressure in the container. When the standard valve is opened, a second passage formed by the connection of the standard valve to the unidirectional valve and the latter to the conduit, allows for a continuous flow of fluid from the container around the closed unidirectional valve and through the standard valve to the atmosphere.

9 Claims, 7 Drawing Sheets

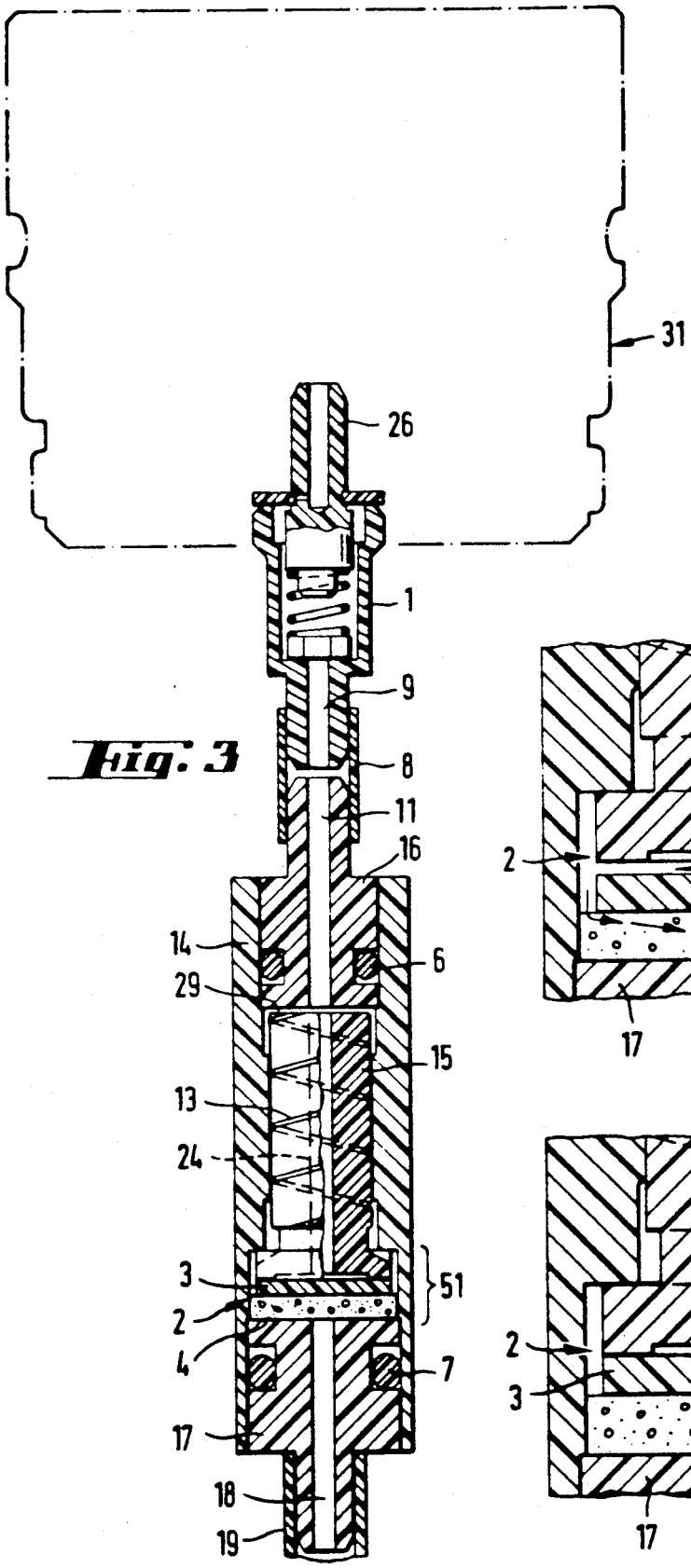
Fig. 3
Fig. 4
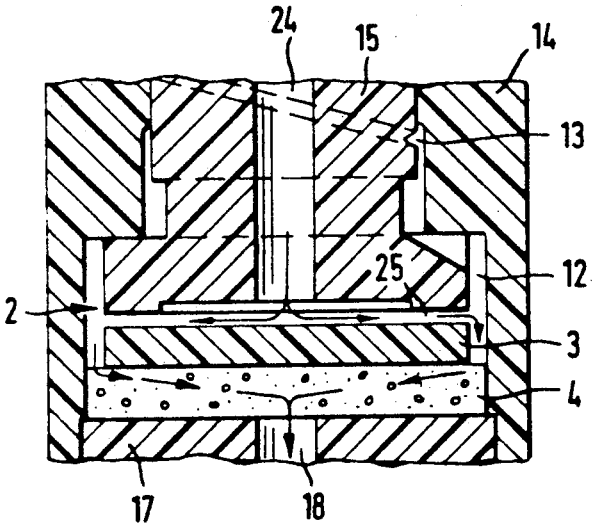
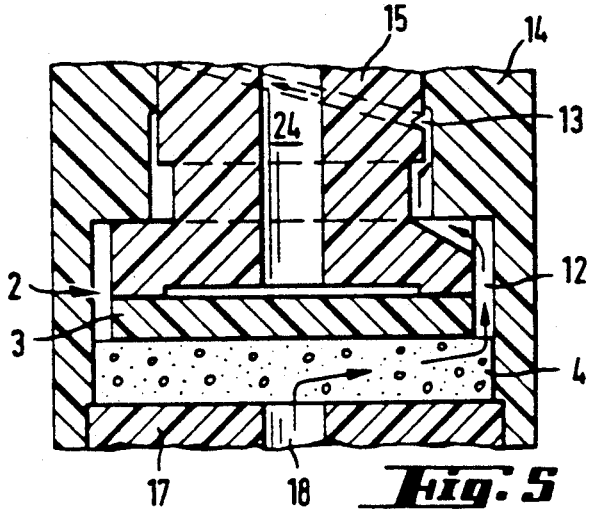
Fig. 5

VALVE FOR AEROSOL CONTAINER

The invention relates to a valve device for an aerosol container.

The invention also relates to a method of utilization of such a device.

Conventional aerosol dispensers generally comprise a container under pressure provided with a valve device fixed on its nozzle neck, the device being intended both for filling and dispensing of the active product. A valve device of this kind is described, for example, in U.S. Pat. No. 3,096,003.

In numerous cases, a known valve device of this kind does not satisfy the user's requirements. This is the case, for example, when an aerosol dispenser is used to dispense a deodorizer. On the one hand the user would like to obtain an immediate and controlled appreciable deodorizing effect at the time he so requires by simple manipulation of the dispenser. On the other hand, he would like the deodorizing effect to be kept at a desirable level over a relatively long period without his having to take any action for the purpose.

These desirable effects cannot be obtained with the known valve devices. An appreciable and immediate deodorizing effect at the start of the use Of the dispenser is impossible unless the user wishes to carry out a relatively inconvenient manipulation of the valve device by himself holding the dispenser valve open by application of pressure to a push-button or by actuating the push button several times in succession until he obtains the required deodorizing effect. It is not possible to obtain a controlled deodorizing effect with a conventional valve device because the user does not have the means of accurately determining the volume of deodorizing product delivered.

With the known valve devices it is also impossible to maintain a deodorizing effect for a varying length of time without the user's active participation.

The invention is based on the problem of overcoming the limitations of the known valve devices by proposing a new valve device whereby the above-mentioned desirable effects can be achieved.

To this end, according to the invention, the problem is solved by a valve device for an aerosol container, such device being characterised in that it comprises:

a) a standard valve for an aerosol container, b) a closure member adapted to hold the standard valve open or closed selectively, c) a unidirectional valve connected on one side to the standard valve and on the other side to a conduit adapted to be connected to a plunger tube adapted to connect the valve device to the interior of the aerosol container, and d) means allowing a continuous flow of fluid from the container through the plunger tube and the conduit, around the unidirectional valve, and through the standard valve to atmosphere while the standard valve is open;

the means which allow the continuous flow comprising connecting means inserted between the standard valve and the conduit.

The advantages provided by this invention consist essentially in that it enables the following objectives to be achieved simultaneously:

At the moment the user opens the standard valve by actuating the cap he obtains a relatively high initial rate of flow defined substantially by the volume of the hollow spaces of the connecting means forming part of the valve device. The user can, for example, thus obtain an immediate and controlled appreciable deodorizing effect at the instant he wishes to start using the dispenser, and this is achieved with a simple manipulation comprising opening the cap of the standard valve.

After the initial relatively high rate of flow, a relatively low continuous rate of flow is provided by the means which allow a continuous flow of fluid from the container. By keeping the closure member of the standard valve in the open position the user can thus also obtain a deodorizing effect which is kept at a desirable level over a relatively long period of time without his having to take any action.

An impregnation element disposed at the base of the closure device allows a non-volatile part of the active product to be collected where applicable. This impregnation element can, for example, thus produce a persistent deodorizing effect and act as a static deodorizer.

In the case in which the aerosol dispenser is used as a static deodorizer, the valve device according to the invention provides a deodorizing effect by combining an immediate deodorizing effect followed by a continuous deodorizing effect and a persistent deodorizing effect.

The controlled flow system according to the invention enables all the ingredients to be fully dispensed during use, and to take the case of a perfume for example this applies to the head, middle fractions and the tailings, which are simultaneously restored.

The invention is explained in greater detail hereinafter with reference to drawings which illustrate just a few embodiments and in which:

FIG. 3 is a reduced-scale section of the valve device shown in FIG. 1.

FIGS. 4 and 5 each represent an enlarged sectional view of the portion 51 in FIG. 3. FIG. 4 shows the unidirectional valve 2 in the open position. FIG. 5 shows this unidirectional valve in the closed position.

Figure 1:
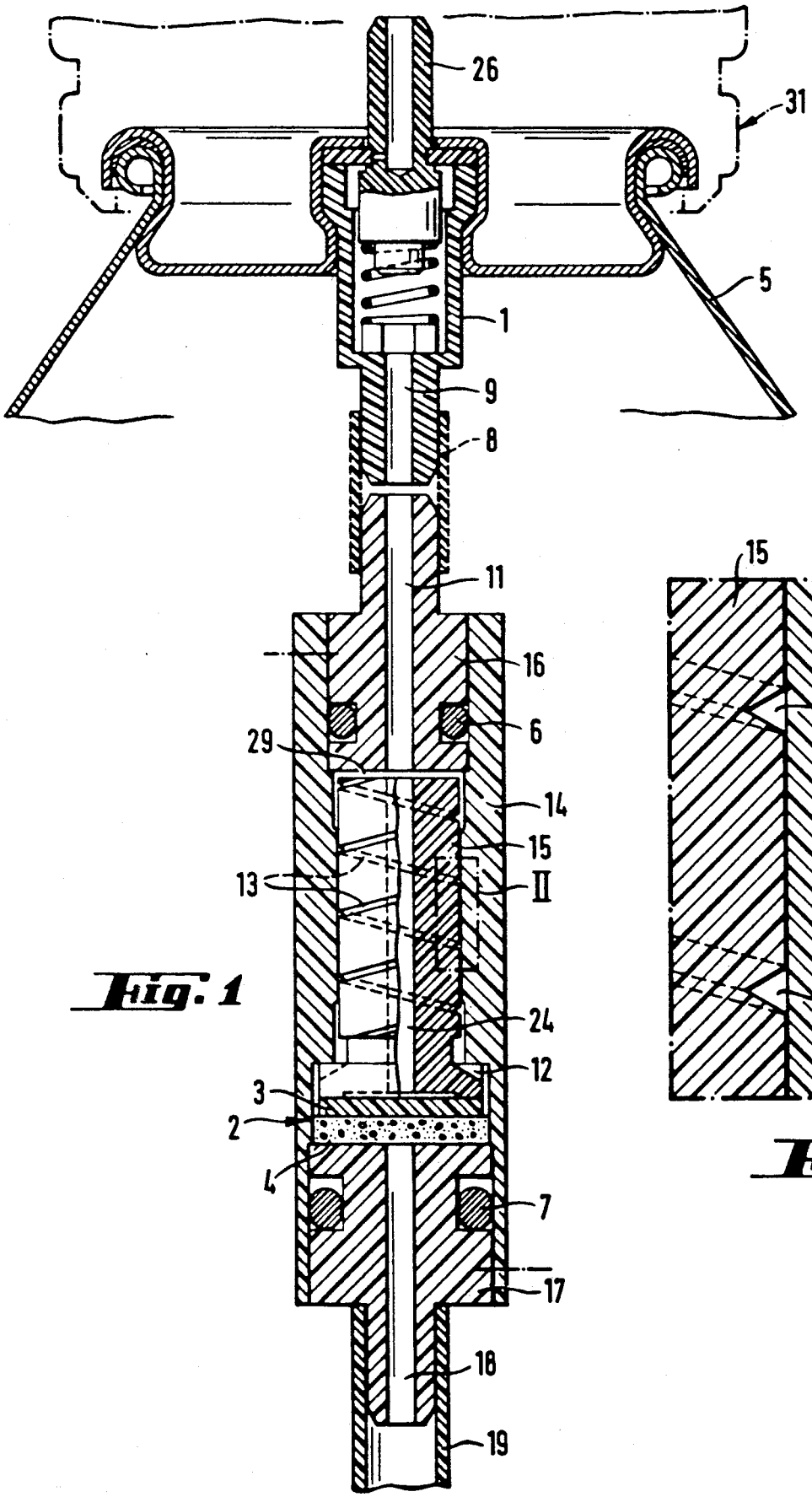
FIG. 1 is a section of a first embodiment of a valve device according to the invention.
Figure 6:
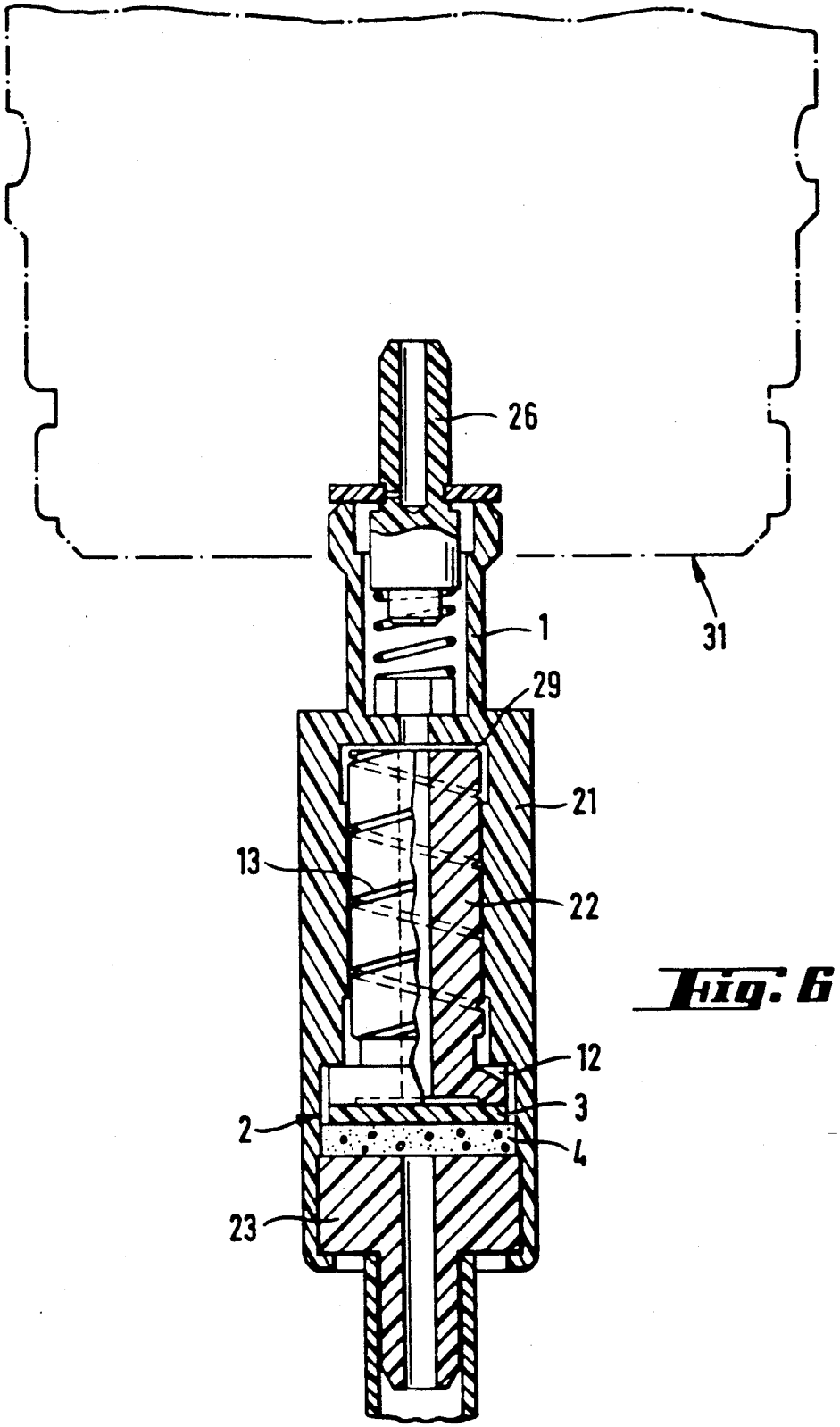

FIG. 6 is a sectional view of a more compact version of the valve device according to FIG. 1.

Figure 7:
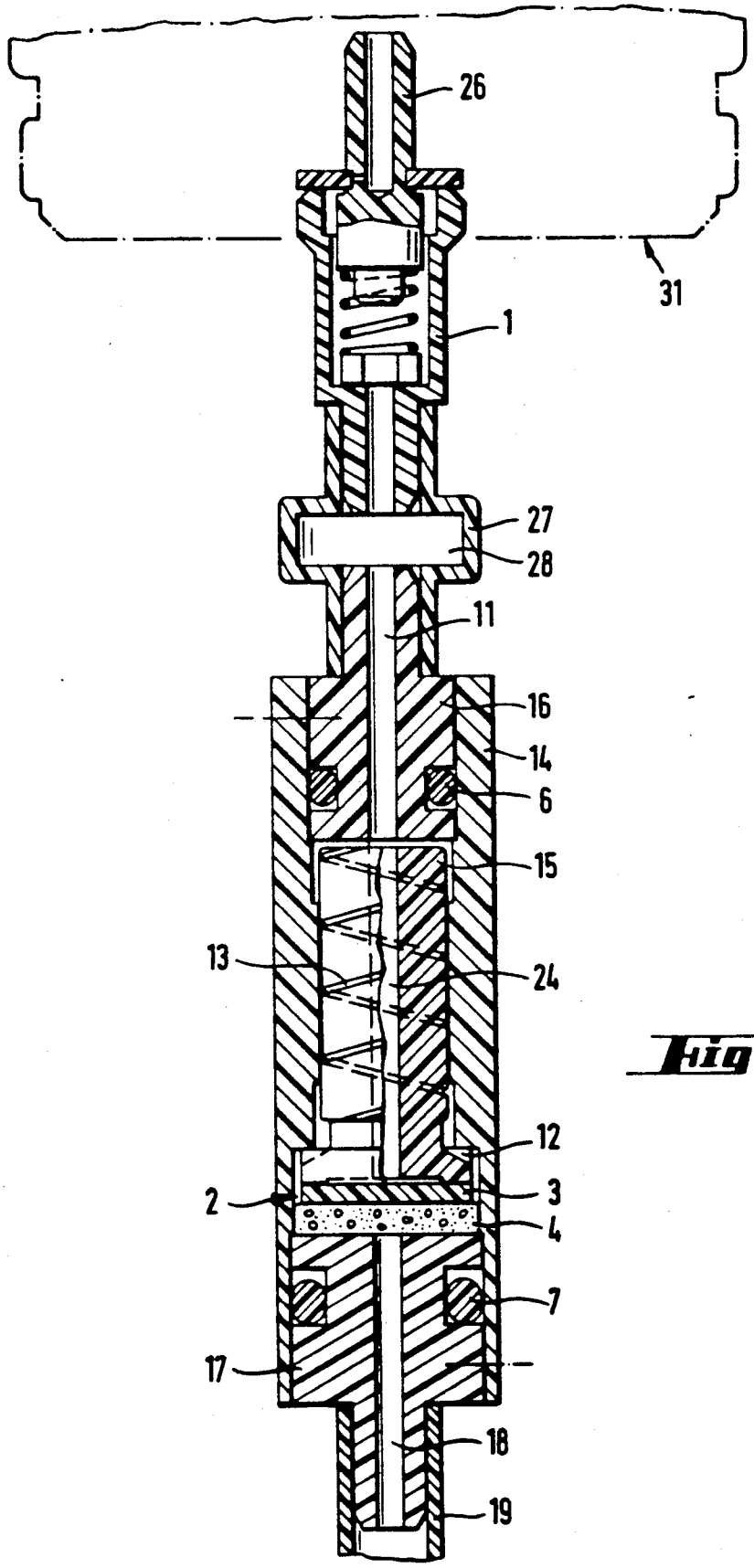

FIG. 7 is a sectional view of a second embodiment of a valve device according to the invention.

Figure 8:
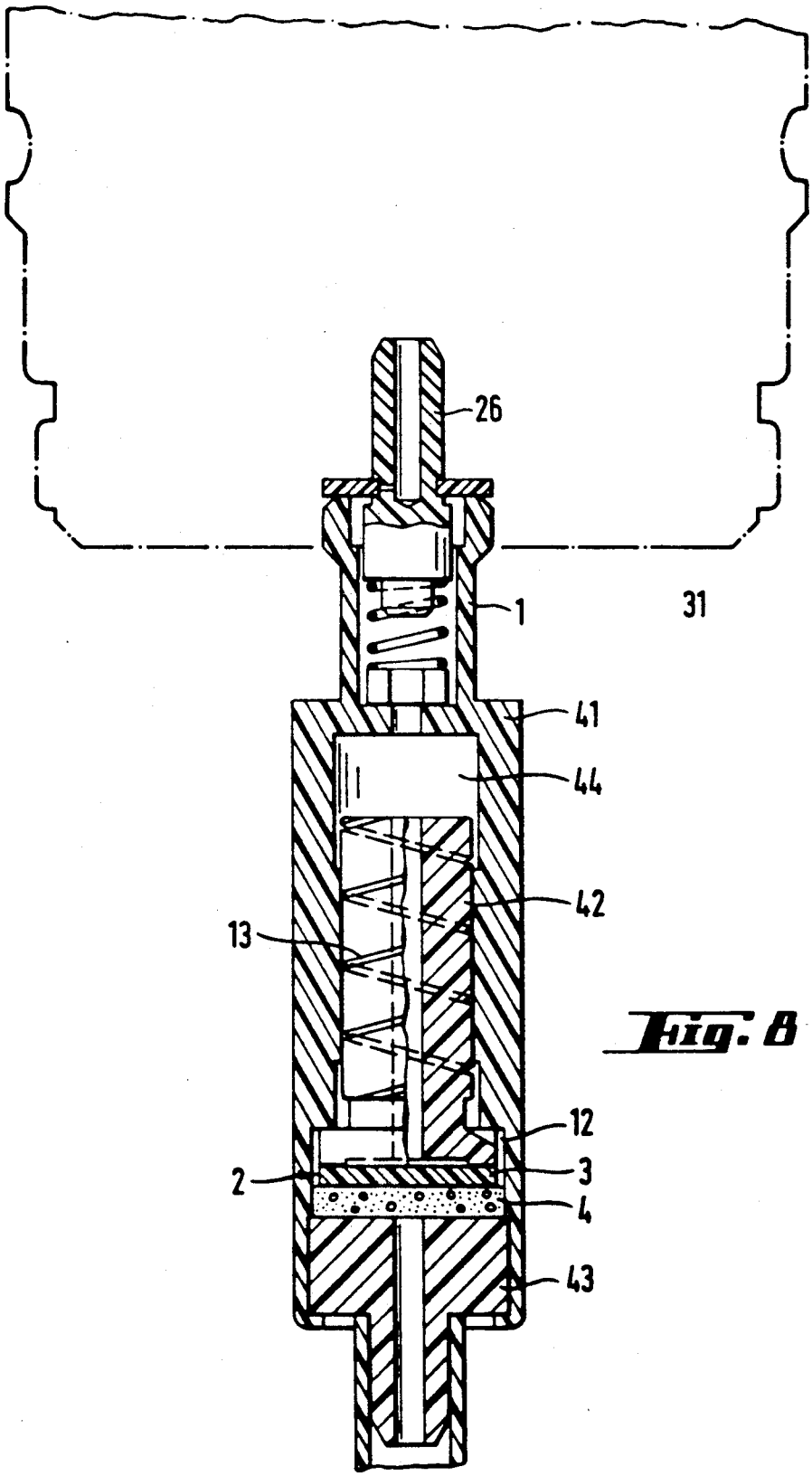

FIG. 8 is a sectional view of a more compact version of the valve device according to FIG. 7.

Figure 9:
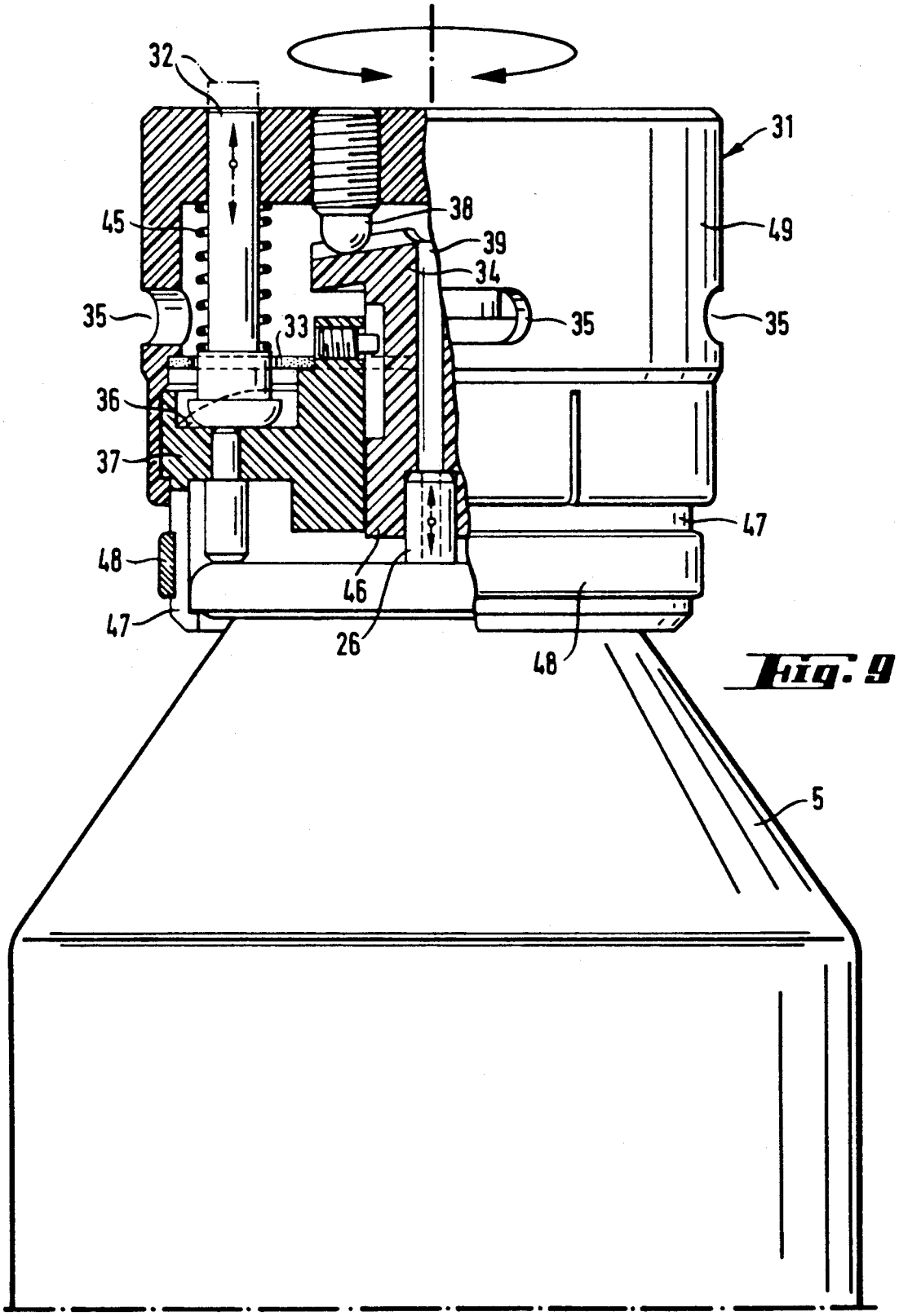

FIG. 9 is a partial sectional view of the closure cap 31 shown in FIG. 1.

Figure 10:
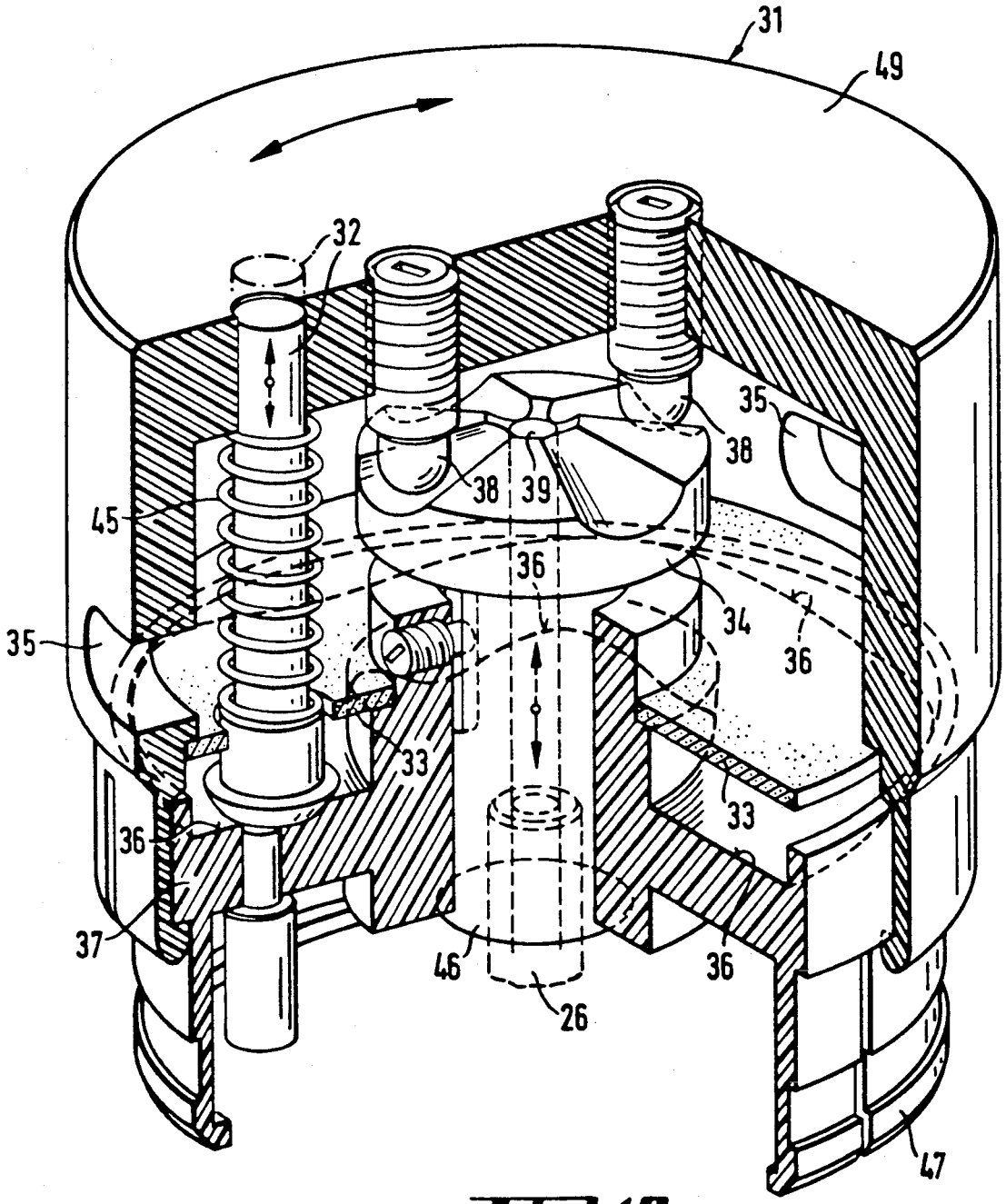

FIG. 10 is a perspective and partial section of the closure cap 31 shown in FIG. 9.

As shown in FIG. 1, a first embodiment of a valve device according to the invention comprises a standard valve 1 for an aerosol container 5 shown diagrammatically by broken lines, a closure member 31 adapted to hold the standard valve 1 open or closed selectively, a unidirectional valve 2 one side of which is connected to the standard valve 1 and the other side of which is connected to a conduit 18 adapted to be connected to a plunger tube 19 adapted to connect the valve device to the interior of the aerosol container 5, and connecting elements 14, 15, 16, 17 allowing a continuous flow of the fluids from the container 5 through the plunger tube 19 and the conduit 18 around the unidirectional valve 2, and through the standard valve 1 to atmosphere while the standard valve 1 is open. The connecting elements 14, 15, 16, Which form part Of the means allowing the continuous flow of the fluids, are inserted between the standard valve 1 and the element 17 connecting with the conduit 18. The body of the standard valve 1 and the connecting element 16 are connected by a connecting element 8 shown diagrammatically by broken lines in FIG. 1. The sealing-tight connection between the connecting elements 14 and 16, on the one hand, and 14 and 17 on the other hand, is provided by gaskets 6 and 7 respectively.

The body of the standard valve 1 contains a conduit 9. The connecting elements 14 and 16 have axial ducts 24 and 11 respectively. The connecting element 17 contains the conduit 18.

Figure 2:
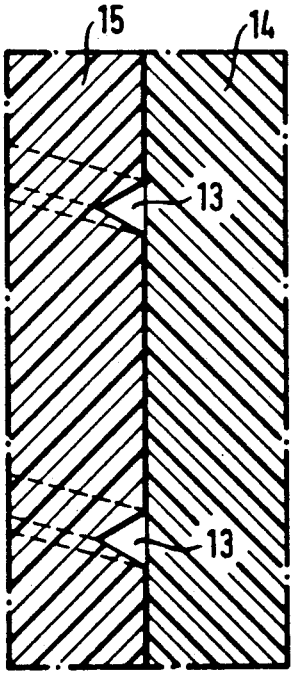
FIG. 2 is an enlarged sectional view of a portion of the passage 13 in FIG. 1.

A passage 13 is formed by the space between the screwthreaded cylindrical connecting element 15 and the bore of the cylindrical connecting element 14. The connecting element 15 is fitted into the bore of the connecting element 14. FIG. 2 is an enlarged sectional view of the portion of the passage 13 which is ringed in FIG. 1. The passage 13 is essentially a tube of a much smaller section than the section of the axial duct 11. In the above-described embodiment, the passage 13 extends along a helicoidal line. The passage 13 constitutes a pressure drop element having a specific hydraulic resistance. By varying the depth of the screwthread and/or the screwthread pitch it is a simple matter to obtain an appreciable variation in the resistance to flow through the passage 13.

The structure and method of operation of the standard valve 1 are conventional. To open this valve pressure is applied to the end of the conduit 26 and hence to the spring incorporated in the standard valve. This pressure allows the conduit 26 to move downwards to open the valve.

All the connecting elements forming part Of the valve device according to FIG. 1 are preferably made from an industrial polyacetal (polyoxymethylene) plastic, e.g. Delrin (Registered Trade Mark).

FIGS. 4 and 5 are more detailed views of a part 51 comprising the unidirectional valve 2 shown in FIG. 1 and in the reduced scale version shown in FIG. 3. The unidirectional valve 2 is a non-return valve comprising a circular diaphragm 3 and a spring element 4. If butane is used as the propellent fluid, the diaphragm 3 is preferably made of Neoprene and the spring element 4 is made of polyurethane foam. These two materials are compatible with butane. If another propellent fluid is used, materials compatible with the propellant must be selected for the diaphragm 3 and the spring element In the embodiment shown in FIGS. 4 and 5 the diaphragm 3 has a thickness of 1 mm.

Within the context of the invention it is possible to use any propellant fluid, e.g. butane, isobutane, propane (liquefied petroleum gases) or dimethyl ether, or chlorofluorohydrocarbons or fluorohydrocarbons, and so on. Each of these propellants may be used in the pure state or in mixture with another.

The active products used will be those generally found in aerosol compositions for deodorizers, such as perfumes, solvents, disinfectants, deodorizers, and so on. Dry sprays are also conventionally used such applications.

FIG. 6 is a sectional view of a more compact version of the valve device according to FIG. 1. The version of the device shown in FIG. 6 has a smaller number of elements than that of the device shown in FIG. 1. In the version of the device according to FIG. 6, the body of the standard valve 1 and the connecting elements 16 and 14 are integrated into a single element 21. The connecting elements 22 and 23 correspond to the connecting elements 15 and 17 respectively in FIG. 1. By appropriate choice of snap-fit methods and the dimensions, the gaskets 6 and 7 in the device according to FIG. 1 are not required in the version of the device according to FIG. 6. This latter version therefore represents an appreciable simplification which allows moulding and assembly costs to be reduced.

FIG. 7 is a section of a second embodiment of a valve device according to the invention. This second embodiment contains all the elements of the valve device shown in FIG. 1 and also a connecting element 27 inserted between the standard valve 1 and the connecting means formed by the assembly of connecting elements 16, 14, 15. The connecting element 27 defines a chamber 28 which on one side is connected to the said connecting means 16, 14, 15 and on the other side to the standard valve 1.

FIG. 8 is a section of a more compact version of the valve device according to FIG. 7. In the device shown in FIG. 8, the element 41 replaces the assembly of elements denoted by the valve body of the standard valve 1, the connecting element 27 and the connecting elements 16 and 14. The connecting elements 42 and 43 correspond to the connecting elements 15 and 17 respectively in FIG. 7. The device according to FIG. 8 comprises a chamber 44 corresponding to the chamber 28 in the device shown in FIG. 7. The device shown in FIG. 8 has the same advantages of simplification as the device shown in FIG. 6.

FIGS. 9 and 10 are details of the structure of the closure member 31 which is an element of the valve device according to FIG. 1 which is shown diagrammatically in this Figure.

The closure member 31 comprises essentially a cap 49 and means for controlling the opening and closure respectively of the standard valve, such means being associated with said cap. Cap 49 is mounted on a fixed base 47 which is fixed to the standard valve 1 by a clamp collar 48. Cap 49 has a projection 38 extending axially towards the interior of the cap. The top wall of the cap 49 is formed with an orifice through which a cylindrical position indicator 32 can move. The side wall of the cap 49 has four evaporation orifices 35 disposed around the perimeter of said side wall at 90° intervals.

A crimped plinth 37 defining a cam having a bottom 36 of variable depth, is fixed on the cap 49. The central part of the plinth 37 has a cylindrical body through which a connecting element 46 can move axially, said element 46 carrying a cam 34 at the top end. The bottom end of the connecting element 46 is connected to the conduit 26 at the top end of the standard valve 1 (FIG. 1).

The position indicator 32 is held in place by means of a spring 45 which tends to move the position indicator downwards.

In a preferred embodiment the cap 49 also has an absorbent washer 33 in the form of an annular cellulose disc. This disc has a notch through which the base of the position indicator 32 is in direct contact with the cam 36.

The cap 49 can be rotated around the longitudinal axis of the container 5 in either direction.

As shown in FIG. 10, the shape of the cam 34 is such that when the cap is turned its projection 38 results in axial movement of the connecting element 46 along the longitudinal axis of the container 5. Such movement allows the standard valve 1 in FIG. 1 to be opened or closed.

Since the cam 36 has a variable depth and rotates with the cap 49, rotation of the latter also results in axial movement of the position indicator 32. In the embodiment shown in FIG. 9, the position indicator 32 is moved upwards when the standard valve 1 is open, and this indicator is moved downwards when the standard valve is in the closed position.

As shown in FIG. 9, the connecting element 46 has an axial duct 39 which allows the fluid coming from the standard valve 1 to flow to the interior of the cap 49 and escape to atmosphere through the evaporation orifices 35.

The main aspects of the operation of the valve device according to the invention will now be described with reference to FIGS. 1 to 5.

Four different states of operation can be distinguished:

1) Filling of the container

Before the closure member 31 is fitted to the standard valve 1, the aerosol container 5 is filled via the standard valve 1 by opening the latter and applying liquid under pressure to its inlet. The unidirectional valve 2 is then opened by the pressure applied and its elements 3, 4 assume the position shown in FIG. 4. In its open position, the unidirectional valve 2 allows the liquid applied under pressure to flow through the standard valve 1, the passages 11 and 24 of the connecting elements 16 and 15, respectively, the passage 25 between the connecting element 15 and the same diaphragm 3, through the spring element 4, the conduit 18 and the plunger tube 19, to the interior of the aerosol container 5. In this way this container can be filled at a relatively high rate of flow and hence in a relatively short time.

2) Container closed

On completion of the filling of the container 5, the standard valve 1 is closed. The pressure inside the container then presses the diaphragm 3 against the base of the connecting element 15, and this diaphragm 3 and the spring element 4 assume the position shown in FIG. 5. In this state the unidirectional valve 2 is closed and the liquid under pressure cannot flow through the passage 24. With the standard valve 1 closed the pressure in the container extends as far as the gasket of the standard valve 1. This is possible because even with the unidirectional valve 2 in the closed position the pressure inside the container 5 can extend through the spring element 4 and the very small-section passages, like the passages 12, 13, 29 contained between the various connecting elements shown in FIG. 1.

In the state of operation just described, the axial passage 9, 11, 24 and all the hollow spaces inside the valve device remain filled with fluid after filling of the container 5.

The diaphragm 3 of the unidirectional valve 2 is held applied against the base Of the connecting element 15 by the spring element 4.

After the container 5 has been filled, the closure member 31 is fitted thereto, thus ensuring that the standard valve is kept in the closed position. The assembly of the valve device remains in the above-described state until the start of the use of this device as an aerosol dispenser.

3) Initial phase on opening of standard valve

At the instant the standard valve 1 is opened, the volume of fluid contained in the axial duct formed by the passage 9, 11, 24 between the -standard valve 1 and the unidirectional valve 2 is brought to atmospheric pressure and the initial flow escaping through the standard valve 1 is defined essentially by the volume of the ducts 9, 11, 24 and by the speed of evaporation of the propellent fluid. By suitable selection of the dimensions of the ducts 9, 11, 24 it is possible to have in said ducts the required initial volume of fluid and hence define an initial relatively high predetermined rate of flow. In the embodiments shown in FIGS. 7 and 8 the chambers 28 and 44 respectively allow a particularly high initial volume of delivery to be defined.

After opening Of the standard valve 1, a pressure difference is established between the two surfaces of the diaphragm 3 of the unidirectional valve 2. This pressure difference firmly applies the diaphragm 3 against the base of the connecting element 15. The unidirectional valve 2 thus remains closed and prevents the flow of fluid through the axial duct 24.

4) Established condition (after the initial phase) with the standard valve in the open position If the standard valve 1 is left open after the above-described initial phase, the pressure in the axial duct formed by the passage 9, 11, 24 is stabilized at a value close to atmospheric pressure and the unidirectional valve 2 remains closed as a result of the above-mentioned pressure difference. In this state, a continuous flow of the fluid contained in the container 5 is established via the plunger tube 19, conduit 18, around the unidirectional valve 2, through the passages 12, 13, 29, 11, 9 and through the standard valve 1 to atmosphere. The value of this continuous flow, which is much smaller than the flow in the initial phase, is defined essentially by the hydraulic resistance of the passage 13. Suitable choice of the dimensions of this Passage therefore allows a predetermined continuous flow to be defined.

The operation of the embodiments according to FIGS. 6 to 8 is similar to that described above for the embodiments shown in FIGS. 1 to 5.

The operation of the closure member 31 in FIG. 1 will now be described by reference to FIGS. 9 and 10. With the embodiment shown in these Figures, opening and closing of the standard valve 1 respectively are produced by a quarter-revolution turn of the cap 49, in either direction. The dimensions of the cap are selected ergonomically for convenience of use when the cap is rotated its projection 38 co-operates with the cam 34 to produce an axial movement of the connecting element 46. When this movement is in the downward direction, i.e. against the resistance of the spring inside the standard valve 1, the movement of the connecting element 46 results in a corresponding movement of the end 26 of the standard valve and in this way results in opening of said valve. A movement of the connecting element 46 in the opposite direction causes the standard valve to close. In addition to the movement of the connecting element 46, rotation of the cap 49 produces a simultaneous movement of the position indicator 32 as a result of the co-operation of the cam 36 (which turns with the cap 49) with the base of said position indicator. The position of the indicator 32 is therefore directly linked to the position of the connecting element 46 so that the position of the indicator 32 indicates to the user whether the standard valve is open or closed.

When the closure member 31 brings the standard valve 1 into the open position, the fluid for dispensing flows through the duct 39 and the connecting element 46, penetrates to the interior of the cap via the top orifice of the duct 39 and escapes to atmosphere via the evaporation orifices 35 of the cap 49.

The cellulose washer 33 is an impregnation element which, where applicable, enables the non-volatile constituent of the active product to be collected. The washer 33 can thus, for example, act as a static deodorizer.

If, when the aerosol distributor is used continuously - and provided that the container still contains an adequate quantity of aerosol -, the user decides to interrupt operation for a varying length of time, he only has to close the closure member 31 and hence the standard valve 1. If the period during which the standard valve remains closed is sufficiently long, the ducts 24, 11, 9 and the hollow spaces of the standard valve fill with fluid through the ducts 12, 13, 29 (as in the continuous flow condition) until the pressure inside the ducts 24, 11, 9 is close to that inside the container. The dispenser is then ready to deliver a relatively large initial volume as at the start of the use of the dispenser.

We claim:

1. A valve device for an aerosol container, said device comprising:

a) a first valve which is crimped on said aerosol container, said valve having a body, a chamber formed in said body and a movable closure element in said chamber, said closure element separating said chamber from the atmosphere when in a closed position, said first valve being held in a closed position by a force exerted on said movable closure element by a first spring located within said body of said first valve;

b) an actuator of said closure element of said first valve, said actuator being outside said aerosol container, said first valve being openable by depression of said actuator and thereby of said movable closure element in a direction contrary to said force of said spring on said movable closure element;

c) a closure member for acting on said actuator for selectively holding said first valve either open or closed;

d) a second valve located within said aerosol container, said second valve being connected on one side to said chamber formed in said body of said first valve and on the opposite side to a conduit connected to a plunger tube for connecting said valve device to the interior of said aerosol container, said second valve having a movable diaphragm as closure element and said second valve being held closed by the force exerted on said diaphragm by a second spring and by fluid under pressure contained in said aerosol container;

e) a first connecting means defining a first passage one end of which forms a connection to said chamber formed in said body of said first valve, the opposite end of said first passage being closed by said diaphragm of said second valve when said second valve is held closed; and, f) a second connecting means which cooperates with said first connecting means to define a second passage which passes around said diaphragm of said second valve, said second passage providing a connection between said chamber formed in said body of said first valve and said conduit.

2. A valve device according to claim 1, further comprising a connecting element inserted between said first valve and said first connecting means, said connecting element defining a chamber, one side of which is connected to said first connecting means and the other side of which is connected to said chamber formed in said first valve.

3. A valve device according to claim 1, characterized in that said closure member comprises an impregnation element for collecting non-volatile elements of the active products of the aerosol contained in said container.

4. A valve device according to claim 1, wherein said second passage has a specific hydraulic resistance for limiting the rate of flow to a predetermined value.

5. A valve device according to claim 1, characterized in that said second passage comprises a tube of a smaller section than the section of said first passage, said tube extending along a helicoidal line.

6. A valve device according to claim 1, characterized in that a part of said second passage is formed by the space between a first cylindrical connecting element and a second screwthreaded cylindrical connecting element inserted in the first cylindrical connecting element.

7. A valve device according to claim 1, characterized in that said closure member comprises means for opening or closing said first valve by rotation of a cap connected to said first valve, said means allowing said first valve to be kept open or closed.

8. A valve device according to claim 7, characterized in that said closure member further comprises a position indicator means which is activated by a partial rotation of said cap to indicate that said first valve is in the open or closed position.

9. A method of using a valve according to claim 1, which comprises:

a) filling said aerosol container through said first valve by opening said valve, by applying liquid under pressure to that inlet of said first valve so that said second valve is opened by the pressure applied and allows said liquid to flow through said first valve, said first passage of said first connecting means, through said second valve in the open position, said conduit and said plunger tube, to the interior of said aerosol container, b) closing said first valve allowing the pressure exerted by said liquid under pressure stored in said container to close said second valve and said second spring element to hold said second valve closed so that the flow of fluid through said first passage of said first connecting means is interrupted, c) opening said first valve and keeping said valve open initially to allow said liquid under pressure contained in the hollow spaces of said first connecting means and of said first valve to flow out to the atmosphere, and then allowing a continuous flow of the fluid contained in the container through said plunger tube, said conduit, around said second valve, through said second passage and through said first valve to atmosphere.

* * * * *